US005106091A

United States Patent [19]

Comito

[11] Patent Number: 5,106,091

[45] Date of Patent: Apr. 21, 1992

[54] TRAJO COMPUTERIZED ELECTRONIC GAMING DEVICE

[76] Inventor: Paul Comito, 904 1st Ave., Silvis, Ill. 61202

[21] Appl. No.: 569,542

[22] Filed: Aug. 20, 1990

[51] Int. Cl.[5] ..... A63F 5/04

[52] U.S. Cl. ..... 273/142 H; 273/85 G; 273/142 JA; 273/309

[58] Field of Search ..... 273/85 G, 138 R, 138 A, 273/139, 142 H, 142 HA, 142 J, 142 JA, 142 JB, 142 JC, 142 JD, 309

[56] References Cited

U.S. PATENT DOCUMENTS 3,975,022 8/1976 Figueroa ..... 273/142 JA X

*Primary Examiner*—William H. Grieb

*Attorney, Agent, or Firm*—Mark A. Appleton

[57] ABSTRACT

A gaming device, which automatically displays projected odds for a particular result or combination of results and registers the projected results that a player selects, comprises a random number or figure or color generator, a computer used in conjunction with software designed for such purpose and a display area for viewing projected odds and projected results.

4 Claims, 3 Drawing Sheets

TRAJO COMPUTERIZED ELECTRONIC GAMING DEVICE

BACKGROUND OF THE INVENTION

This invention relates to a combination of games and devices designed especially for adult entertainment and more particularly to games of a roulette wheel type which may be automated. Such a devise is used in conjunction with a computer which generates a series of odds or a specific payout for a combination of colors and numbers, or sums of numbers, or types of numbers and which payout may then be compared to the results generated by and selected from one or more wheels or any other type of random generators.

The basic purpose of the present invention is to provide an automated gaming machine which is designed to be used in conjunction with a computerized calculator of odds and played on a game board that can display the results of the gaming machine, which game board also displays the odds for certain predetermined combinations as calculated by the computerized calculator and which game board will also allow the player to select and display the players choices of such combinations prior to play. From the results as displayed on the board, an operator of the game may award the players their appropriate prize. Alternately the device can be housed in a unit which accomplishes all of the purposes of the invention but requires no operator. An additional alternative may be added which varies the odds of payout based upon the number of players or other criteria selected by the house.

Heretofore games such as roulette were played with a single number or color generator, specifically a roulette wheel and payouts were made on predetermined odds fixed by the operator of the device.

Accordingly, an object of the invention is to provide a device which is capable of generating a variety of both colors or numbers or both from one or more random number or color generating devices such as roulette-type wheels or computerized random generators. A further object is to provide a means for the generation of specific odds based upon the numbers and colors or combination thereof selected by the player which the player believes will be displayed by the one or more random generators. A further object of the invention is to provide a means for displaying the odds calculated by the odds calculating means. An additional object of the invention is to provide a surface upon which players may register their selections prior to play and upon which the calculated odds and results of the random generators may be displayed.

The invention in one embodiment has as a further object, the automation of play such that the player may interact with the device alone so that play may be achieved without assistance or interaction with other players or operators.

The invention may be better understood by reference to the following description in connection with the accompanying drawings.

DESCRIPTION OF THE EMBODIMENTS

Figure 1:
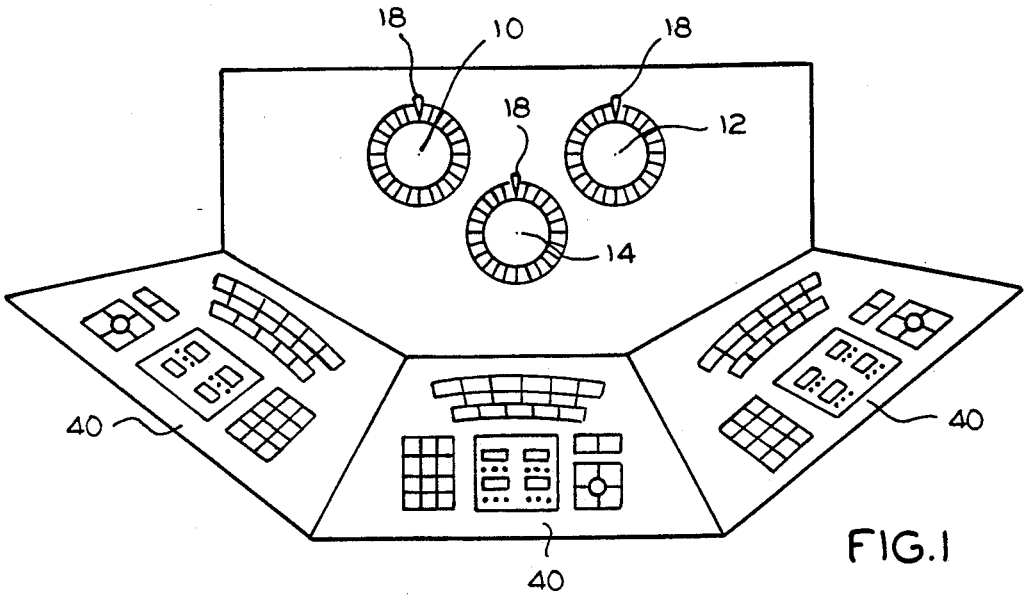
FIG. 1 is a perspective view of a preferred embodiment of the machine.
Figure 2:
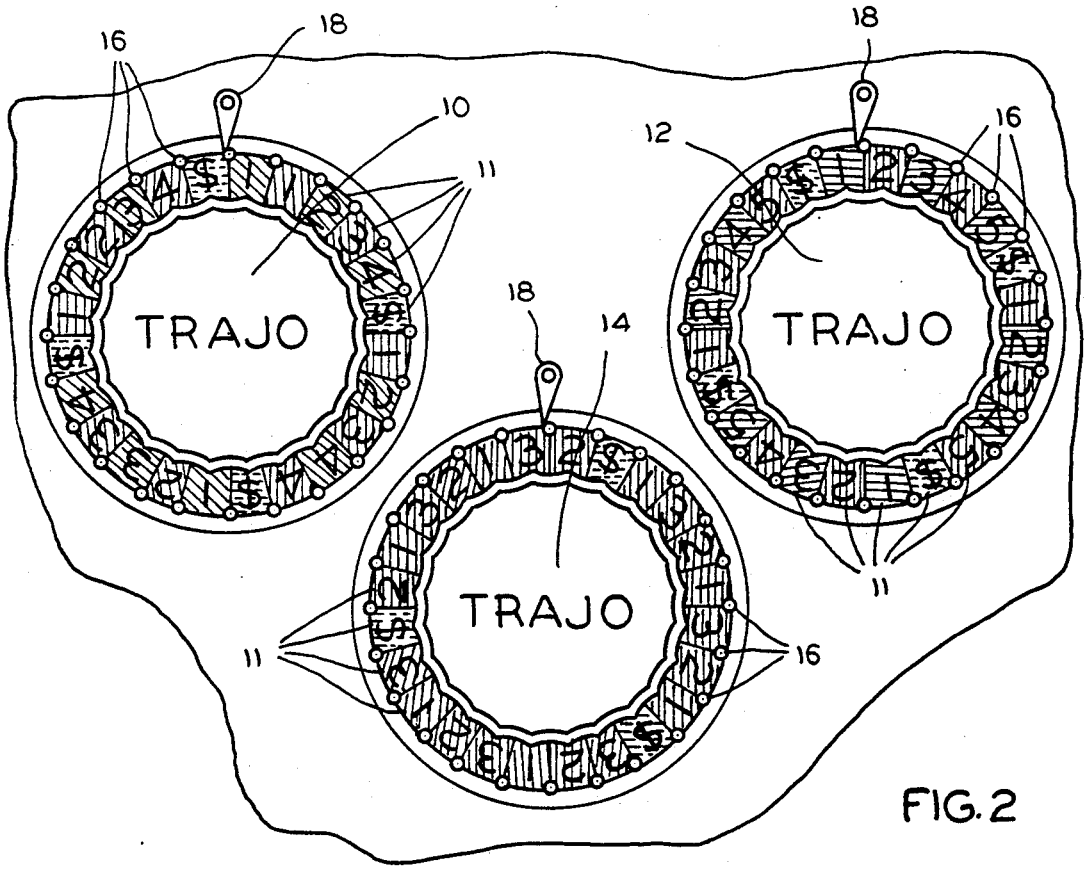
FIG. 2 is a plan view of the mechanical random number and color generators.

In one embodiment the device consists of three mechanical colored random number generators 10, 12 and 14 as shown in FIGS. 1 and 2 with generators 10, 12 and 14 being of different colors, i.e. 10 being green, 12 being blue and 14 being red. The mechanical generators have a different series of numbers or FIGS. 11 located about the periphery which may be colored differently. Such mechanical number generators may be rotated simultaneously around each of their respective centers and as each rotates the pegs 16 located about the circumference of each random generator 10, 12 and 14 strike a pointer 18 which allows the peg 16 to pass as it strikes the pointer 18 by deforming pointer 18 in the same direction of rotation but then recovering to its original position as pointer 18 looses contact with peg 16. As the friction created by motion causes each mechanical generator 10, 12 and 14 to come to a halt the pointer 18 will be pointing to a single number thus selecting the colored number 11 or FIG. 11 on each colored wheel 10, 12 or 14 for use in play.

Figure 3:
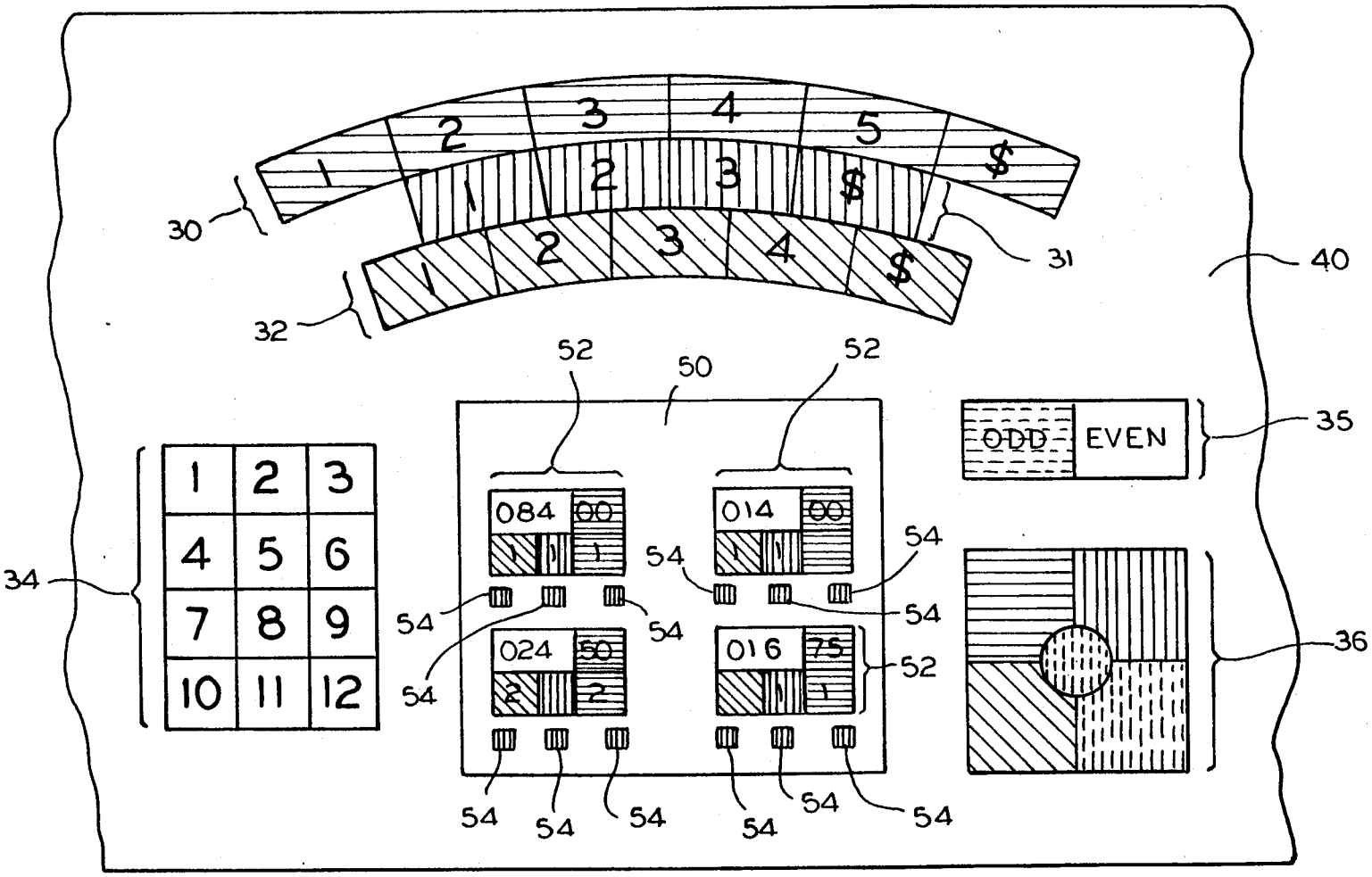
FIG. 3 is a plan view of the table with the different bet registering areas and odds display.

A player who has previously selected a number or figure he believes will be displayed by a particular colored number generator may place a bet by putting a chip on the corresponding number displayed in row 30, 31 or 32 located on the board 40 as shown in FIG. 3. The player may also bet on the total of all of the numbers 11 generated by placing a bet in the corresponding box located at area 34 of board 40 as shown in FIG. 3 or may bet that the total of such numbers will be either an odd number or an even number by placing a bet in the corresponding box of area 35 on board 40 of FIG. 3 and finally may bet on the color of the number or combination of colored numbers selected by one or more wheels by placing a bet in the corresponding colored box or on the line between colored boxes in area 36 of the board 40 as shown in FIG. 3.

Figure 5:
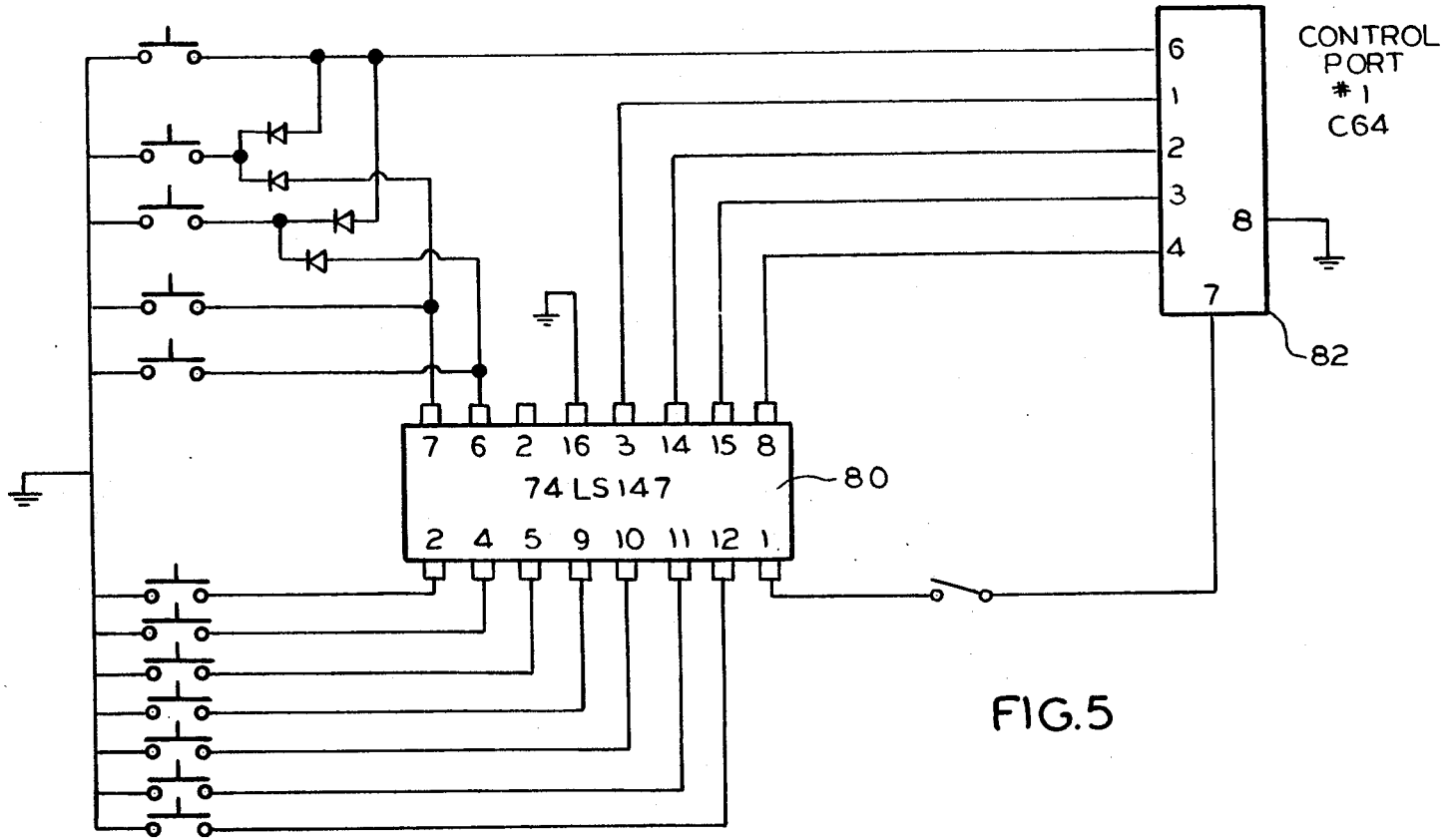
FIG. 5 is a simplified block and circuit diagram of the circuitry added to a standard computer so as to permit input and output to such computer to and from such device.

The board 40 may also be used to display the odds a player would be allowed on any particular bet or combination of bets by scrolling through the particular bet or combination of bets the player is considering in area 50 of board 40 in FIG. 3 which comprises a video monitor 52 that receives the calculated odds information from computer 60. Selection of a particular combination is made by setting switch 54 as shown in FIG. 5. The information sought is relayed from the computer 60 via the control part number 1 for instance of a Commador C64 computer through a commercial available chip 74 LA 147 which is specially adapted for the process and displayed on Monitor 52.

Figure 4:
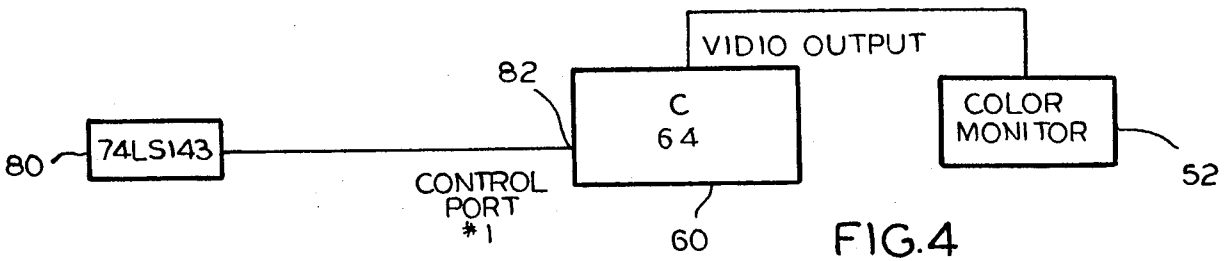
FIG. 4 is a simplified block and circuit diagram of the machine odds displaying portions of the device.

FIG. 4 is a simplified block diagram demonstrating the connection between chip 80 which is commonly available as commercial chip number 74 LS 147, the control part of the computer 82 which is in one embodiment a Commador Model C64 Computer 60 and the video monitor 84.

Another embodiment may be presented wherein bets may be registered directly with the computer through the replacement of the board 40 with a touch information display terminal thus allowing the player to interact exclusively with the gaming device.

The software which calculates the odds for display on monitor 52 may be altered to include variables such as an increase or decrease in the rate of return to the operator and it may also take into account the number of players betting on a particular set of numbers to be generated thereby increasing or decreasing the odds calculated and displayed.

The preferred embodiments of the present invention have been described herein and shown in the accompanying drawing to illustrate the underlying principles of the invention, but it is to be understood that a number of modifications or alternate embodiments may be made utilizing either the components described herein, the alternate components described herein, or their equivalents in a variety of combinations, all without departing from the spirit and scope of the invention.

The programing for the computer may be adapted for any type of computing devise, but the program as listed in the basic language for use in conjunction with the Commador C64 compute comprising nine (9) sheets illustrating such a preferred embodiment of the computer software code contemplated by the inventor disclosed herein is attached hereto at the conclusion of the specifications.

```
  5  DIM US$(8,8,8): DIM SS$(8,8,8): DIM MS$(8,8,8)
 10  PRINT CHR$ (147): PRINT : PRINT
 15  PRINT CHR$ (144): POKE 53281,1: PRINT : POKE 53280,0
 20  PRINT "PLEASE SET ODDS": PRINT
 30  PRINT "HOUSE      OTHER"
 40  PRINT "      EVEN"
 50  PRINT "  V     V     V"
 55  PRINT "  Q     W     E"
 60  ZZ = PEEK (197): IF  ZZ = 64 THEN  60
 70  IF  ZZ = 9 THEN  PCT = 1: PRINT CHR$ (147): PRINT : PRINT
     : PRINT "  SETTING ODDS     "
 75  IF  ZZ = 9 THEN  PRINT : PRINT "      (EVEN)": PRINT : PRINT
     "  STAND-BY ": GOTO 200
 80  IF  ZZ = 62 THEN  PRINT CHR$ (147): PRINT : PRINT : PRINT
     "  SETTING ODDS": PRINT
 85  IF  ZZ = 62 THEN  PRINT "  (HOUSE)": PRINT : PRINT "   "
       STAND-BY": GOTO 300
 88  PRINT CHR$ (147)
 90  PRINT CHR$ (19)
100  PRINT : PRINT : PRINT : PRINT " % HOUSE PAYS ": PRINT TAB(
     7)W * 10 + E
110  PRINT " ENTER" TAB( 6)W TAB( 11)E
120  PRINT "  V     V     V"
121  PRINT "  Q     W     E"
122  ZZ = PEEK (197): IF  ZZ = 14 THEN  122
124  ZZ = PEEK (197): IF  ZZ = 9 THEN  124
130  ZZ = PEEK (197): IF  ZZ = 64 THEN  130
135  REM  Q=62 W=9 E=14
140  IF  ZZ = 62 THEN  PCT = (W * 10 + E) * .01:W = 0:E = 0:
     GOTO 200
150  IF  ZZ = 9 THEN  W = W + 1: IF  W = 16 THEN  W = 0
160  IF  ZZ = 14 THEN  E = E + 1: IF  E = 10 THEN  E = 0
170  GOTO 90
200  WA(0) = 1
201  WA(1) = 3.43
202  WA(2) = 3.43
203  WA(3) = 3.43
204  WA(4) = 8:WA(6) = 8
210  WB(0) = 1
211  WB(1) = 4.8
212  WB(2) = 4.8
213  WB(3) = 4.8
214  WB(4) = 4.8
215  WB(5) = 6:WB(6) = 6
220  WC(0) = 1
```

```
221  WC(1) = 6
222  WC(2) = 6
223  WC(3) = 6
224  WC(4) = 6
225  WC(5) = 6
226  WC(6) = 6
227  FOR ZJE = 1 TO 24: PRINT "
     .                    "
228  NEXT

 240  GOTO 500
 300  WA(0) = 1:PCT = .816: GOTO 300
 301  WA(1) = 3
 302  WA(2) = 3
 303  WA(3) = 3
 304  WA(4) = 7:WA(6) = 7
 310  WB(0) = 1
 311  WB(1) = 4
 312  WB(2) = 4
 313  WB(3) = 4
 314  WB(4) = 4
 315  WB(5) = 5:WB(6) = 5
 320  WC(0) = 1
 321  WC(1) = 5
 322  WC(2) = 5
 323  WC(3) = 5
 324  WC(4) = 5
 325  WC(5) = 5
 326  WC(6) = 5
 327  FOR ZJE = 1 TO 24: PRINT "
      .                    "
 328  NEXT
 500  UH$(1) = " ┐ ":UH$(6) = " ╭╮ "
 510  MH$(1) = " │ ":MH$(6) = " ├┤ "
 515  BH$(1) = " ┴ ":BH$(6) = " ╰╯ "
 520  UH$(2) = " ╭╮ ":UH$(7) = " ╭┐ "
 525  MH$(2) = " ╭╯ ":MH$(7) = " ╭╯ "
 530  BH$(2) = " ╰┘ ":BH$(7) = " ┴ "
 535  UH$(3) = " ╭╮ ":UH$(8) = " ╭╮ "
 540  MH$(3) = " ┤ ":MH$(8) = " ├┤ "
 545  BH$(3) = " ╰╯ ":BH$(8) = " ╰╯ "
 550  UH$(4) = " ╭┐ ":UH$(9) = " ╭╮ "
 555  MH$(4) = " └┼ ":MH$(9) = " ╰┤ "
 560  BH$(4) = "  ┴ ":BH$(9) = " ╰╯ "
 565  UH$(5) = " ┌┐ ":UH$(0) = " ╭╮ "
 570  MH$(5) = " └┘ ":MH$(0) = " │ │ "
 575  BH$(5) = " ╰╯ ":BH$(0) = " ╰╯ "
2000  REM  PAY OFF
2010  FOR X = 0 TO 2
2015  .   FOR Y = 0 TO 2
2020  .   .   FOR Z = 0 TO 1
2025  .   .   .   XD = X:YD = Y
2026  .   .   .   IF  X = 2 THEN  XD = 4
2027  .   .   .   IF  Y = 2 THEN  YD = 5
2030  .   .   .   IVL = WA(XD) * WB(YD) * WC(Z) * PCT: REM  %
      .   .   .   ONTTHIS LINE
2034  .   .   .   IF  Y + Z = 0 AND WA(XD) < > 3.43 AND PCT =
```

```
     .   .   .   .816 THEN  IVL = 6
2035 .   .   .   IF  X + Y + Z = 0 THEN  IVL = 1
2036 .   .   .   IF  IVL - INT (IVL) > .50 THEN  IVL = INT (
     .   .   .   IVL) + 1: GOTO 2045
2040 .   .   .   IF  IVL - INT (IVL) < .51 THEN  IVL = INT (
     .   .   .   IVL)
2045 .   .   .   HK = INT (IVL / 100)
2050 .   .   .   H2 = INT ((IVL - (HK * 100)) / 10)
2060 .   .   .   H3 = INT (IVL - (HK * 100) - (H2 * 10))
2070 .   .   .   H5 = INT (IVL * 10 - (HK * 1000) - (H2 * 10
     .   .   .   0) - (H3 * 10))
2080 .   .   .   H7 = INT (IVL * 100 - (HK * 10000) - H2 * 1
     .   .   .   000 - H3 * 100 - H5 * 10)
2200 .   .   .   US$(WB(YD),WA(XD),WC(Z)) = UH$(HK) + UH$(H2
     .   .   .   ) + UH$(H3) + "▨" + UH$(H5) + UH$(H7) + "▩"
     .   .   .
2205 .   .   .   MS$(WB(YD),WA(XD),WC(Z)) = MH$(HK) + MH$(H2
     .   .   .   ) + MH$(H3) + "▨" + MH$(H5) + MH$(H7) + "▩"
     .   .   .
2210 .   .   .   BS$(WB(YD),WA(XD),WC(Z)) = BH$(HK) + BH$(H2
     .   .   .   ) + BH$(H3) + "▨" + BH$(H5) + BH$(H7) + "▩"
     .   .   .
2250 .   .   NEXT Z
2260 .   NEXT Y
2270 NEXT X
3200 REM  SET NUB
3201 AWL$(0) = "▨     ▩"
3202 BWL$(0) = "▨     ▩"
3203 CWL$(0) = "▨     ▩"
3204 DWL$(0) = "▨     ▩"
3205 EWL$(0) = "▨     ▩"
3211 AWL$(1) = "▨     "
3212 BWL$(1) = "▨  ┐  "
3213 CWL$(1) = "▨  │  "
3214 DWL$(1) = "▨  ┴  "
3215 EWL$(1) = "▨     "
3221 AWL$(2) = "▨     "
3222 BWL$(2) = "▨  ⌒  "
3223 CWL$(2) = "▨  ⌒  "
3224 DWL$(2) = "▨  └┘ "
3225 EWL$(2) = "▨     "
3231 AWL$(3) = "▨     "
3232 BWL$(3) = "▨  ⌒  "
3233 CWL$(3) = "▨  ┼  "
3234 DWL$(3) = "▨  ⌣  "
3235 EWL$(3) = "▨     "
3241 AWL$(4) = "▨     "
3242 BWL$(4) = "▨  ┌┐ "
3243 CWL$(4) = "▨  ├┼ "
3244 DWL$(4) = "▨  ┴  "
3245 EWL$(4) = "▨     "
3251 AWL$(5) = "▨     "
3252 BWL$(5) = "▨  ┌┐ "
3253 CWL$(5) = "▨  └┘ "
3254 DWL$(5) = "▨  ⌣  "
3255 EWL$(5) = "▨     "
3261 AWL$(6) = "▨     "
```

```
3262  BWL$(6) = "▨ ┬ "
3263  CWL$(6) = "▨ ┴ "
3264  DWL$(6) = "▨ ┼ "
3265  EWL$(6) = "▨   "
3300  GOTO 4005
3600  PRINT CHR$ (147): DIM P1(13)
3610  PRINT CHR$ (144): PRINT
3615  FOR JG = 1 TO 12
3617  .   IF  JG = 1 THEN  PN = 24 ↑ 3 / 220 * PCT
3618  .   IF  JG = 2 THEN  PN = 24 ↑ 3 / 532 * PCT
3619  .   IF  JG = 3 THEN  PN = 24 ↑ 3 / 984 * PCT
3620  .   IF  JG = 4 THEN  PN = 24 ↑ 3 / 1464 * PCT
3621  .   IF  JG = 5 THEN  PN = 24 ↑ 3 / 1884 * PCT
3622  .   IF  JG = 6 THEN  PN = 24 ↑ 3 / 2116 * PCT
3623  .   IF  JG = 7 THEN  PN = 24 ↑ 3 / 2084 * PCT
3624  .   IF  JG = 8 THEN  PN = 24 ↑ 3 / 1772 * PCT
3625  .   IF  JG = 9 THEN  PN = 24 ↑ 3 / 1320 * PCT
3626  .   IF  JG = 10 THEN  PN = 24 ↑ 3 / 840 * PCT
3627  .   IF  JG = 11 THEN  PN = 24 ↑ 3 / 420 * PCT
3628  .   IF  JG = 12 THEN  PN = 24 ↑ 3 / 140 * PCT
3630  .   PN = INT (PN * 100) / 100
3632  .   PRINT CHR$ (19)
3633  .   IF  PN < 10 THEN  HH = 1
3636  .   IF  JG > 9 THEN  H = 1
3640  .   F = PN - INT (PN):X = INT (PN)
3642  .   IF  F > .885 OR F = .885 THEN  PN = X + 1
3644  .   IF  F < .885 AND F > .6251 THEN  PN = X + .75
3646  .   IF  F < .625 AND F > .385 THEN  PN = X + .5
3648  .   IF  F < .385 AND F > .125 THEN  PN = X + .25
3649  .   IF  F < .125 THEN  PN = X
3650  .   P1(JG) = PN
3655  .   GOTO 6000
3660  NEXT JG
4005  PRINT CHR$ (19): PRINT
4006  FOR UY = 1 TO 2
4007  .   PRINT CHR$ (144)
4010  .   PRINT US$(WB(Q),WA(W),WC(E));
4015  .   PRINT TAB( 24)US$(WB(Q),WA(W),WC(E))
4016  .   PRINT MS$(WB(Q),WA(W),WC(E));
4017  .   PRINT TAB( 24)MS$(WB(Q),WA(W),WC(E))
4020  .   PRINT BS$(WB(Q),WA(W),WC(E));
4025  .   PRINT TAB( 24)BS$(WB(Q),WA(W),WC(E))
4030  .   PRINT CHR$ (30);AWL$(Q); CHR$ (28);AWL$(W); CHR$ (3
      .   1);AWL$(E); TAB( 24)
4035  .   PRINT CHR$ (30);AWL$(Q); CHR$ (28);AWL$(W); CHR$ (3
      .   1);AWL$(E)
4040  .   PRINT CHR$ (30);BWL$(Q); CHR$ (28);BWL$(W); CHR$ (3
      .   1);BWL$(E); TAB( 24)
4045  .   PRINT CHR$ (30);BWL$(Q); CHR$ (28);BWL$(W); CHR$ (3
      .   1);BWL$(E)
4050  .   PRINT CHR$ (30);CWL$(Q); CHR$ (28);CWL$(W); CHR$ (3
      .   1);CWL$(E); TAB( 24)
4055  .   PRINT CHR$ (30);CWL$(Q); CHR$ (28);CWL$(W); CHR$ (3
      .   1);CWL$(E)
4060  .   PRINT CHR$ (30);DWL$(Q); CHR$ (28);DWL$(W); CHR$ (3
      .   1);DWL$(E); TAB( 24)
4065  .   PRINT CHR$ (30);DWL$(Q); CHR$ (28);DWL$(W); CHR$ (3
      .   1);DWL$(E)
```

```
4070  .   PRINT CHR$ (30);EWL$(Q); CHR$ (28);EWL$(W); CHR$ (3
      .   1);EWL$(E); TAB( 24)
4075  .   PRINT CHR$ (30);EWL$(Q); CHR$ (28);EWL$(W); CHR$ (3
      .   1);EWL$(E)
4080  .   IF  UY = 1 THEN  PRINT : PRINT : PRINT
4085  NEXT UY
4090  Z = 0:X = 0
4100  FOR IOP = 1063 TO 2023 STEP 40: POKE IOP,160: POKE IOP +
      .   54272NEXT
4101  FOR IOP = 1984 TO 2022: POKE IOP,160: POKE IOP + 54272,
      .  NEXT
4900  US$(0,0,0) = UH$(0) + UH$(0) + UH$(1)
4910  MS$(0,0,0) = MH$(0) + MH$(0) + MH$(1) + MH$(0) + MH$(0)

5000  LC = PEEK (197):ZP = PEEK (56320): IF  ZP = 127 AND LC =
      64 THEN  5000
5050  IF  LC = 0 THEN  3600
5100  PRINT CHR$ (19): PRINT : PRINT CHR$ (144)
5140  IF  ZP = 117 OR LC = 62 THEN  Q = Q + 1: GOTO 5200
5143  IF  ZP = 125 OR LC = 9 THEN  W = W + 1: GOTO 5210
5144  IF  ZP = 119 OR LC = 14 THEN  E = E + 1: GOTO 5220
5145  IF  ZP = 111 OR LC = 4 THEN  P = P + 1: GOTO 5230
5146  IF  ZP = 110 OR LC = 5 THEN  O = O + 1: GOTO 5240
5147  IF  ZP = 102 OR LC = 6 THEN  I = I + 1: GOTO 5250
5150  PRINT : PRINT : PRINT : PRINT : PRINT : PRINT : PRINT :
      PRINT : PRINT : PRINT : PRINT : PRINT
5152  IF  ZP = 115 OR LC = 12 THEN  Z = Z + 1: GOTO 5260
5153  IF  ZP = 123 OR LC = 23 THEN  X = X + 1: GOTO 5270
5154  IF  ZP = 116 OR LC = 20 THEN  C = C + 1: GOTO 5280
5156  IF  ZP = 124 OR LC = 47 THEN  M = M + 1: GOTO 5290
5157  IF  ZP = 118 OR LC = 44 THEN  N = N + 1: GOTO 5300
5158  IF  ZP = 126 OR LC = 55 THEN  B = B + 1: GOTO 5310
5200  IF  Q = 5 THEN  Q = 6
5202  IF  Q > 6 THEN  Q = 0
5204  PRINT US$(WB(Q),WA(W),WC(E)): PRINT MS$(WB(Q),WA(W),WC(
      E))
5205  PRINT BS$(WB(Q),WA(W),WC(E))
5206  PRINT CHR$ (30);AWL$(Q): PRINT BWL$(Q): PRINT CWL$(Q): PRINT
      DWL$(Q): PRINT EWL$(Q)
5208  GOTO 5000
5210  IF  W = 4 THEN  W = 6
5212  IF  W > 6 THEN  W = 0
5214  PRINT US$(WB(Q),WA(W),WC(E)): PRINT MS$(WB(Q),WA(W),WC(
      E))
5215  PRINT BS$(WB(Q),WA(W),WC(E))
5216  PRINT CHR$ (28); SPC( 5)AWL$(W): PRINT SPC( 5)BWL$(W): PRINT
      SPC( 5)CWL$(W)
5218  PRINT SPC( 5)DWL$(W): PRINT SPC( 5)EWL$(W): GOTO 5000
5220  IF  E > 6 THEN  E = 0
5224  PRINT US$(WB(Q),WA(W),WC(E)): PRINT MS$(WB(Q),WA(W),WC(
      E))
5225  PRINT BS$(WB(Q),WA(W),WC(E))
5226  PRINT CHR$ (31); SPC( 10)AWL$(E): PRINT SPC( 10)BWL$(E)
      : PRINT SPC( 10)CWL$(E)
7796  PRINT CHR$ (30); SPC( 13)AWL$(Q): PRINT SPC( 13)BWL$(Q)
      : PRINT SPC( 13)CWL$(Q)
7798  PRINT SPC( 13)DWL$(Q): PRINT SPC( 13)EWL$(Q)
```

```
7800  PRINT CHR$ (19): FOR X = 1 TO 8: PRINNEXT
7896  PRINT CHR$ (30); SPC( 13)AWL$(Q): PRINT SPC( 13)BWL$(Q)
      : PRINT SPC( 13)CWL$(Q)
7898  PRINT SPC( 13)DWL$(Q): PRINT SPC( 13)EWL$(Q)
7900  PRINT CHR$ (19): PRINT CHR$ (31)
7910  IF  P > 9 THEN  7922
7912  PRINT TAB( 24)UH$(P)
7913  PRINT TAB( 24)MH$(P)
7914  PRINT TAB( 24)BH$(P)
7920  IF  P < 10 THEN  7930
7922  PRINT TAB( 23)"┐" + UH$(P - 10)
7923  PRINT TAB( 23)"│" + MH$(P - 10)
7924  PRINT TAB( 23)"┴" + BH$(P - 10)
7930  A = INT (P1(P) * .1):B = INT (P1(P)) - (A * 10):C = INT
      (P1(P) * 10) - INT (P1(P)) * 10
7933  D = P1(P) * 100 - INT (P1(P) * 10) * 10: IF  A = 0 THEN
      7942
7936  PRINT TAB( 20)UH$(A)UH$(B)" "UH$(C)UH$(D)
7938  PRINT TAB( 20)MH$(A)MH$(B)" "MH$(C)MH$(D)
7940  PRINT TAB( 20)BH$(A)BH$(B)"."BH$(C)BH$(D): GOTO 7945
7942  PRINT TAB( 20)UH$(B)" "UH$(C)UH$(D)
7943  PRINT TAB( 20)MH$(B)" "MH$(C)MH$(D)
7944  PRINT TAB( 20)BH$(B)"."BH$(C)BH$(D)
7945  CL = PEEK (197): IF  CL < > 0 THEN  7945
7950  GOTO 7000
5228  PRINT SPC( 10)DWL$(E): PRINT SPC( 10)EWL$(E): GOTO 5000

5230  IF  P = 5 THEN  P = 6
5232  IF  P > 6 THEN  P = 0
5234  PRINT SPC( 24)US$(WB(P),WA(O),WC(I)): PRINT SPC( 24)MS$
      (WB(P),WA(O),WC(I))
5235  PRINT SPC( 24)BS$(WB(P),WA(O),WC(I))
5236  PRINT CHR$ (30); SPC( 24)AWL$(P): PRINT SPC( 24)BWL$(P)
      : PRINT SPC( 24)CWL$(P)
5238  PRINT SPC( 24)DWL$(P): PRINT SPC( 24)EWL$(P): GOTO 5000

5240  IF  O = 4 THEN  O = 6
5242  IF  O > 6 THEN  O = 0
5244  PRINT SPC( 24)US$(WB(P),WA(O),WC(I)): PRINT SPC( 24)MS$
      (WB(P),WA(O),WC(I))
5245  PRINT SPC( 24)BS$(WB(P),WA(O),WC(I))
5246  PRINT CHR$ (28); SPC( 29)AWL$(O): PRINT SPC( 29)BWL$(O)
      : PRINT SPC( 29)CWL$(O)
5248  PRINT SPC( 29)DWL$(O): PRINT SPC( 29)EWL$(O): GOTO 5000

5250  IF  I > 6 THEN  I = 0
5254  PRINT SPC( 24)US$(WB(P),WA(O),WC(I)): PRINT SPC( 24)MS$
      (WB(P),WA(O),WC(I))
5255  PRINT SPC( 24)BS$(WB(P),WA(O),WC(I))
5256  PRINT CHR$ (31); SPC( 34)AWL$(I): PRINT SPC( 34)BWL$(I)
      : PRINT SPC( 34)CWL$(I)
5258  PRINT SPC( 34)DWL$(I): PRINT SPC( 34)EWL$(I): GOTO 5000

5260  IF  Z = 5 THEN  Z = 6
5262  IF  Z > 6 THEN  Z = 0
5264  PRINT US$(WB(Z),WA(X),WC(C)): PRINT MS$(WB(Z),WA(X),WC(
      C))
```

```
5265  PRINT BS$(WB(Z),WA(X),WC(C))
5266  PRINT CHR$ (30);AWL$(Z): PRINT BWL$(Z): PRINT CWL$(Z): PRINT
      DWL$(Z): PRINT EWL$(Z)
5268  GOTO 5000
5270  IF  X = 4 THEN  X = 6
5272  IF  X > 6 THEN  X = 0
5274  PRINT US$(WB(Z),WA(X),WC(C)): PRINT MS$(WB(Z),WA(X),WC(
      C))
5275  PRINT BS$(WB(Z),WA(X),WC(C))
5276  PRINT CHR$ (28); SPC( 5)AWL$(X): PRINT SPC( 5)BWL$(X): PRINT
      SPC( 5)CWL$(X)
5278  PRINT SPC( 5)DWL$(X): PRINT SPC( 5)EWL$(X): GOTO 5000
5280  IF  C > 6 THEN  C = 0
5284  PRINT US$(WB(Z),WA(X),WC(C)): PRINT MS$(WB(Z),WA(X),WC(
      C))
5285  PRINT BS$(WB(Z),WA(X),WC(C))
5286  PRINT CHR$ (31); SPC( 10)AWL$(C): PRINT SPC( 10)BWL$(C)
      : PRINT SPC( 10)CWL$(C)
5288  PRINT SPC( 10)DWL$(C): PRINT SPC( 10)EWL$(C): GOTO 5000

5290  IF  M = 5 THEN  M = 6
5292  IF  M > 6 THEN  M = 0
5294  PRINT SPC( 24)US$(WB(M),WA(N),WC(B)): PRINT SPC( 24)MS$
      (WB(M),WA(N),WC(B))
5295  PRINT SPC( 24)BS$(WB(M),WA(N),WC(B))
5296  PRINT CHR$ (30); SPC( 24)AWL$(M): PRINT SPC( 24)BWL$(M)
      : PRINT SPC( 24)CWL$(M)
5298  PRINT SPC( 24)DWL$(M): PRINT SPC( 24)EWL$(M): GOTO 5000

5300  IF  N = 4 THEN  N = 6
5302  IF  N > 6 THEN  N = 0
5304  PRINT SPC( 24)US$(WB(M),WA(N),WC(B)): PRINT SPC( 24)MS$
      (WB(M),WA(N),WC(B))
5305  PRINT SPC( 24)BS$(WB(M),WA(N),WC(B))
5306  PRINT CHR$ (28); SPC( 29)AWL$(N): PRINT SPC( 29)BWL$(N)
      : PRINT SPC( 29)CWL$(N)
5308  PRINT SPC( 29)DWL$(N): PRINT SPC( 29)EWL$(N): GOTO 5000

5310  IF  B > 6 THEN  B = 0
5314  PRINT SPC( 24)US$(WB(M),WA(N),WC(B)): PRINT SPC( 24)MS$
      (WB(M),WA(N),WC(B))
5315  PRINT SPC( 24)BS$(WB(M),WA(N),WC(B))
5316  PRINT CHR$ (31); SPC( 34)AWL$(B): PRINT SPC( 34)BWL$(B)
      : PRINT SPC( 34)CWL$(B)
5318  PRINT SPC( 34)DWL$(B): PRINT SPC( 34)EWL$(B): GOTO 5000

6000  PRINT CHR$ (19):X = JG
6005  IF  X > 3 AND X < 10 THEN  6010
6008  GOTO 6020
6010  AK = AK + 5: PRINT TAB( AK)UH$(X): PRINT TAB( AK)MH$(X)
      : PRINT TAB( AK)BH$(X)
6015  PRINT TAB( AK)PN: GOTO 3660
6020  PRINT : PRINT : PRINT : PRINT : PRINT
6025  IF  X < 3 OR X > 10 THEN  PRINT : PRINT : PRINT : PRINT
      : PRINT
6027  IF  X < 2 OR X = 12 THEN  PRINT : PRINT : PRINT : PRINT
      : PRINT
```

```
6035  IF  X < 4 THEN  PRINT UH$(X): PRINT MH$(X): PRINT BH$(X
      ): PRINT PN: GOTO 3660
6040  PRINT TAB( 34)"┐" + UH$(X - 10)
6043  PRINT TAB( 34)"│" + MH$(X - 10)
6048  PRINT TAB( 34)"┴" + BH$(X - 10)
6050  PRINT TAB( 34)PN
6055  IF  X = 12 THEN  GOTO 6100
6060  GOTO 3660
6100  PRINT CHR$ (19): PRINT : PRINT : PRINT : PRINT : PRINT
      :X = 31
6110  PRINT CHR$ (31)
6120  PRINT TAB( 14)"▨ ┌┴▩ ╲  │"
6130  PRINT TAB( 14)"▨ └┐▩ │╲│"
6140  PRINT TAB( 14)"▨ ┬┘▩ │  ╲"
6160  PRINT TAB( 14)WB(6) * PCT"   "WB(2) * PCT
6210  PRINT CHR$ (28)
6220  PRINT TAB( 14)"▨ ┌┴▩ ╲  │"
6230  PRINT TAB( 14)"▨ └┐▩ │╲│"
6240  PRINT TAB( 14)"▨ ┬┘▩ │  ╲"
6260  PRINT TAB( 14)WA(6) * PCT,WA(2) * PCT
6310  PRINT CHR$ (30)
6320  PRINT TAB( 14)"▨ ┌┴▩ ╲  │"
6330  PRINT TAB( 14)"▨ └┐▩ │╲│"
6340  PRINT TAB( 14)"▨ ┬┘▩ │  ╲"
6360  PRINT TAB( 14)WC(6) * PCT,WC(2) * PCT
6400  ZP = PEEK (197): IF  ZP = 64 THEN  6400
7000  PRINT CHR$ (147)
7010  PRINT "EEEW": INPUT WQR
7100  PRINT "GREEN"
7105  INPUT Q
7110  PRINT "RED": INPUT W
7120  PRINT "BLUE": INPUT E
7130  PRINT "TOTAL": INPUT P
7200  PRINT CHR$ (144): PRINT CHR$ (147)
7204  PRINT US$(WB(Q),WA(W),WC(E)): PRINT MS$(WB(Q),WA(W),WC(
      E))
7205  PRINT BS$(WB(Q),WA(W),WC(E))
7206  PRINT CHR$ (30);AWL$(Q): PRINT BWL$(Q): PRINT CWL$(Q): PRINT
      DWL$(Q): PRINT EWL$(Q)
7210  PRINT CHR$ (19): PRINT : PRINT : PRINT
7216  PRINT CHR$ (28); SPC( 5)AWL$(W): PRINT SPC( 5)BWL$(W): PRINT
      SPC( 5)CWL$(W)
7218  PRINT SPC( 5)DWL$(W): PRINT SPC( 5)EWL$(W)
7220  PRINT CHR$ (19): PRINT : PRINT : PRINT
7226  PRINT CHR$ (31); SPC( 10)AWL$(E): PRINT SPC( 10)BWL$(E)
      : PRINT SPC( 10)CWL$(E)
7228  PRINT SPC( 10)DWL$(E): PRINT SPC( 10)EWL$(E)
7300  PRINT CHR$ (144)
7304  PRINT SPC( 20)US$(WB(Q),WA(W),WC(O)): PRINT SPC( 20)MS$
      (WB(Q),WA(W),WC(O))
7305  PRINT SPC( 20)BS$(WB(Q),WA(W),WC(O))
7330  PRINT : PRINT
7334  PRINT SPC( 20)US$(WB(O),WA(W),WC(E)): PRINT SPC( 20)MS$
      (WB(O),WA(W),WC(E))
7335  PRINT SPC( 20)BS$(WB(O),WA(W),WC(E))
7336  PRINT : PRINT
```

```
7364  PRINT SPC( 20)US$(WB(Q),WA(O),WC(E)): PRINT SPC( 20)MS$
      (WB(Q),WA(O),WC(E))
7365  PRINT SPC( 20)BS$(WB(Q),WA(O),WC(E))
7406  PRINT CHR$ (19): FOR X = 1 TO 13: PRINNEXT
7426  PRINT CHR$ (31); SPC( 18)AWL$(E): PRINT SPC( 18)BWL$(E)
      : PRINT SPC( 18)CWL$(E)
7428  PRINT SPC( 18)DWL$(E): PRINT SPC( 18)EWL$(E)
7436  PRINT CHR$ (31); SPC( 18)AWL$(E): PRINT SPC( 18)BWL$(E)
      : PRINT SPC( 18)CWL$(E)
7438  PRINT SPC( 18)DWL$(E): PRINT SPC( 18)EWL$(E)
7510  PRINT CHR$ (19): FOR X = 1 TO 8: PRINNEXT
7516  PRINT CHR$ (28); SPC( 18)AWL$(W): PRINT SPC( 18)BWL$(W)
      : PRINT SPC( 18)CWL$(W)
7518  PRINT SPC( 18)DWL$(W): PRINT SPC( 18)EWL$(W)
7526  PRINT CHR$ (28); SPC( 13)AWL$(W): PRINT SPC( 13)BWL$(W)
      : PRINT SPC( 13)CWL$(W)
7528  PRINT SPC( 13)DWL$(W): PRINT SPC( 13)EWL$(W)
```

I claim:

1. A device comprising:

(a) means for generating random numbers, colors or figures; and (b) a game board which displays calculated odds for combination of numbers or figures or colors generated by said generating means; and (c) means for calculating said odds; and (d) means by which variables used in connection with said calculation may be redefined; and (e) means for requesting a selected combination.

2. The device of claim 1 wherein the means for the calculation of odds comprises software designed for such purpose when used in conjunction with a computer.

3. The device of claim 1 wherein the game board which displays calculated odds also serves as a switch which interfaces with a computer such that the combination selected by the player is transmitted to a computer and the computed odds are transmitted to the game board.

4. The device of claim 1 wherein the means for registering a selected combination is a touch information display terminal.

* * * * *